US006443655B1

(12) United States Patent
Bennett

(10) Patent No.: US 6,443,655 B1
(45) Date of Patent: Sep. 3, 2002

(54) FLOOD BARRIER

(76) Inventor: Robert Bennett, 8 W. Merrick Rd., suite 210, Freeport, NY (US) 11714

( * ) Notice: Subject to any disclaimer, the term of this patent is extended or adjusted under 35 U.S.C. 154(b) by 0 days.

(21) Appl. No.: 09/839,896

(22) Filed: Apr. 21, 2001

(51) Int. Cl.[7] ..... E04H 17/16; E02B 7/02; E02B 3/04; E02B 7/14

(52) U.S. Cl. ..... 405/114; 405/107; 405/110; 405/112; 405/285; 52/169.2; 52/169.9; 52/169.14; 52/780; 256/13; 256/31

(58) Field of Search ..... 405/15, 21, 107, 405/110, 112, 114, 116, 285, 284; 52/169.1, 169.2, 169.9, 169.14, 780; 256/13, 13.1, 19, 31

(56) References Cited

U.S. PATENT DOCUMENTS

| | | | | | |
|---|---|---|---|---|---|
| 830,437 | A | * | 9/1906 | Humphrey | 256/19 |
| 1,714,949 | A | * | 5/1929 | Collier et al. | 256/19 |
| 4,321,774 | A | | 3/1982 | Fish | 52/63 |
| 4,375,929 | A | | 3/1983 | Clark | 405/114 |
| 4,730,810 | A | * | 3/1988 | Rambaud | 244/110 C |
| 4,921,373 | A | | 5/1990 | Coffey | 405/115 |
| 4,979,817 | A | * | 12/1990 | Crisp, Sr. | 256/13.1 |
| 5,040,919 | A | | 8/1991 | Hendrix | 405/115 |
| 5,118,217 | A | | 6/1992 | Younes | 405/114 |
| 5,439,316 | A | | 8/1995 | Richardson | 405/114 |
| 5,470,177 | A | | 11/1995 | Hughes | 405/115 |
| 5,732,935 | A | * | 3/1998 | Codario, Jr. | 256/1 |
| 6,042,301 | A | | 3/2000 | Sovran | 405/112 |
| 6,079,904 | A | * | 6/2000 | Trisl | 405/107 |
| 6,176,638 | B1 | * | 1/2001 | Kellison et al. | 403/267 |
| 6,345,934 | B1 | * | 2/2002 | Jailloux et al. | 405/262 |

* cited by examiner

*Primary Examiner*—Thomas B. Will
*Assistant Examiner*—Tara L. Mayo
(74) *Attorney, Agent, or Firm*—Michael I. Kroll

(57) ABSTRACT

A flood barrier unit is provided for a flood barrier system. Each unit has three pillars attached to pillar footings implanted in the surrounding ground surface. For each pillar a concrete brace member footing is provided for the support of brace members compressively positioned between the pillar tops and the brace member footings. A turnbuckle connects two portions of each brace member, and when properly manipulated, will force the brace member ends into holes in the pillar footings and brace member footings. Barrier panels with tongue-and-groove top and bottom edges form a wall when attached to the pillars using a brace plate and bolts. A water-resistant vapor barrier, with a weighted bottom portion, is draped over the top of the barrier panels for fastening between the pillars and panels using a hook-and-loop fastener and the barrier panel bolts. Alternate embodiments include differing arrangements and numbers of the brace members.

18 Claims, 11 Drawing Sheets

FLOOD BARRIER

FIELD OF THE INVENTION

The present invention relates generally to flood barriers forming a temporary dam, adapted to be raised in a short time, to protect a flood prone area.

DESCRIPTION OF THE PRIOR ART

There are other flood barrier devices designed for protecting flood prone areas. Typical of these is U.S. Pat. No. 6,042,301 issued to Jean-Paul Sovran on Mar. 28, 2000.

Another patent was issued to Daniel C. E. Fish on Mar. 30, 1982 as U.S. Pat. No. 4,321,774. Yet another U.S. Pat. No. 4,921,373 was issued to Robert C. Coffey on May 1, 1990 and still yet another was issued on Aug. 20, 1991 to Glen Hendrix as U.S. Pat. No. 5,040,919.

Another patent was issued to Joseph F. Younes on Jun. 2, 1992 as U.S. Pat. No. 5,118,217. Yet another U.S. Pat. No. 5,439,316 was issued to Cecil A. Richardson on Aug. 8, 1995. Another was issued to Christopher T. Hughes on Nov. 28, 1995, as U.S. Pat. No. 5,470,177.

U.S. Pat. No. 6,042,301

Inventor: Jean-Paul Sovran

Issued: Mar. 28, 2000

A barrier forming a temporary dam that may be erected quickly alongside a river in spate to protect a flood-prone area. The barrier mainly consists of extractable piles fitted in holes in the ground, and removable water-tight members that may be mounted between the piles once they have been drawn out of the respective holes. The watertight members may be made of a stack of metal beams and thick bars.

U.S. Pat. No. 4,321,774

Inventor: Daniel C. E. Fish

Issued: Mar. 30, 1982

A flood barrier comprising a flexible membrane the end and base parts terminating in a beading of polypropylene rope. The side parts of the barrier are located in vertical channel in the side walls and the base in a horizontal extending channel in the floor. In normal conditions the barrier is stowed in the recesses and erected in the event of a flood warning.

U.S. Pat. No. 4,375,929

Inventor: Travis B. Clark

Issued: Mar. 8, 1983

A protective flood barrier comprising panels sealingly attachable to one another to form a continuous barrier around a building structure and sealingly attachable to a fixed foundation surrounding the structure.

U.S. Pat. No. 4,921,373

Inventor: Robert C. Coffey

Issued: May 1, 1990

A fluid containing barrier having a frame with a plurality of legs and a flexible container supported by the frame. The flexible container has a high point vent and low point drain. The flexible container is capable of holding fluid. A series of individual frames and flexible containers interlock to form a wall or flood barrier which is used as a dam structure.

U.S. Pat. No. 5,040,919

Inventor: Glen Hendrix

Issued: Aug. 20, 1991

A containment structure for controlling flood water or spilled liquids comprising an elongated, triangular flexible container to be placed where needed to form a stable, water tight barrier. The containment structure has a spout for introduction of water into the container, a front flap for anchoring the container, and has end pieces adapted ti be used for sealing the end of the container against irregular objects or another container. A floating pump assembly can be provided for filling the container with flood waters.

U.S. Pat. No. Des. 5,118,217

Inventor: Joseph F. Younes

Issued: Jun. 2, 1992

A movable flood barrier requires a permanent channel in the path of expected flood waters and is normally closed by a removable cover. The barrier consists of a series of units dimensioned to be removably seated in the channel and detachably interconnected. Each unit includes at least one panel disposed to face flood waters and a reinforcement to which the panels are attached. The junctions between panels are sealed and seals extend lengthwise of the barrier and are secured to the panels thereto and detachably secured to the channel wall first in the path of the flood waters. Where required, a brace for each unit is detachably secured thereto and to a permanent normally covered socket on the leeward side of the channel.

U.S. Pat. No. 5,439,316

Inventor: Cecil A. Richardson

Issued: Aug. 8, 1995

A reusable flood barrier is provided to erect reusable flood barrier banks. The flood barrier comprises a front panel having a front face, a top edge, a pair of side edges, and a base; a rear support attached to the rear face of the panel to prop the front panel on the base; and an elongated clamp removably and adjustably affixed to the front face of the front panel. The clamp has an edge disposed proximate and substantially parallel to each side edge of the front panel respectively. The clamp is capable of anchoring a long edge of an elongated interconnection gasket. The gasket is capable of placement over the gap between a side edge of the front panel of a first flood barrier and an abutting side edge of the front panel of an adjacent flood barrier. The anchoring action of the clamp on adjacent flood barrier front panels enables the gasket to provide a water seal between the front panels.

While these flood barriers may be suitable for the purposes for which they were designed, they would not be as suitable for the purposes of the present invention, as hereinafter described. It is thus desirable to provide a flood barrier device forming a temporary dam that will be erected at flood prone areas. It is further desirable to provide a flood barrier system comprising a barrier structure that can be easily assembled prior to any storm producing tidal surge warnings to protect coastal communities and property from catastrophic flooding.

SUMMARY OF THE PRESENT INVENTION

A primary object of the present invention is to provide a flood barrier unit designed to be used in a flood barrier system to stop flood waters from destroying property and coastal communities.

Another object of the present invention is to provide a flood barrier unit designed to be used in a flood barrier system that may be assembled prior to flood surge warnings.

Yet another object of the present invention is to provide a flood barrier unit designed to be used in a flood barrier system comprising concrete pillar footings containing threaded holes into which pillars are mounted and threaded.

Still yet another object of the present invention is to provide a flood barrier unit designed to be used in a flood barrier system consisting of concrete brace member footings into which brace members are inserted.

Yet another object of the present invention is to provide a flood barrier unit designed to be used in a flood barrier system comprising three erectable pillars each being mounted by means of a threaded rod located at the bottom of the pillar, to a concrete pillar footing.

Additional objects of the present invention will appear as the description proceeds.

The present invention overcomes the shortcomings of the prior art by providing a flood barrier unit designed to be used in a flood barrier system consisting of a plurality of barrier panels that are bolted to the pillars and are tongue-and-groove connected. Also a vapor barrier covers the flood side of the panels and contains a weighted bottom device sewn into the vapor barrier.

Each unit within the flood barrier system has three pillars that are threadably attached to concrete pillar footings implanted in the ground surface. Each pillar footing has an associated brace member footing for receiving one or more brace member ends, the other end of each brace member being received near the top of the pillars.

Each brace member has two portions joined by a turnbuckle, the manipulation of which forces the brace member ends against the pillar and the brace member footing until the brace member is in compression.

The pillars have bolt holes for the attachment of barrier panels. The barrier panels form a solid wall, made even more watertight by the use of tongue-and-groove joinder along the adjacent top and bottom edges of the barrier panels. A brace plate on the flood side of the barrier panels ensures the integrity of the attachment.

A vapor barrier is draped over the units in the system, with the top edge being fastened between the barrier panels and the pillars. The vapor barrier has a weighted bottom to properly position the vapor barrier as the flood waters rise.

Alternate configurations of the brace members are included.

In one embodiment, the turnbuckle is replaced by a standard coupling.

A barrier unit for connection to like barrier units to form a barrier on a ground surface to protect an area from flood waters is provided, comprising: five elongated brace members, each brace member having a turnbuckle and a first and second portion, each brace member portion having a threaded end, each turnbuckle joining the first and second portion threaded ends of each brace member; a first, second and third pillar, each pillar having a bottom, a positioning member extending downwardly beyond the pillar bottom, and a hole for receiving one of the brace member first portion ends, at least two of the pillars having an additional hole for receiving another of the brace member first portion ends, at least one of the pillars having a second additional hole for receiving yet another of the brace member first portion ends; a first, second and third brace member footing for securing into the ground surface, each having a hole for receiving one of the brace member second portion ends, at least two of the brace member footings each having at least one additional hole for receiving an additional brace member second portion end, the rotation of each turnbuckle moving each brace member first portion end into one of the pillar holes and each brace member second portion end into one of the brace member footing holes; a first, second and third pillar footing for securing into the ground surface, each having a hole for receiving one of the pillar positioning members; a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars; the pillar and brace member footings being positioned such that the first brace member is compressively positioned between the first brace member footing and the first pillar, the second brace member is compressively positioned between the first brace member footing and the second pillar, the third brace member is compressively positioned between the second brace member footing and the second pillar, the fourth brace member is compressively positioned between the third brace member footing and the second pillar, and the fifth brace member is compressively positioned between the third brace member footing and the third pillar.

In another embodiment, the panels are fastened to the pillars by bolts.

In another embodiment, the vapor barrier is penetrated by at least one bolt on each of the pillars.

In another embodiment, the barrier unit further comprises at least one hook and loop fastener for fastening the vapor barrier to at least one of the panels.

In another embodiment, each of the panels has a back side, each of the hook and loop fasteners fastening the vapor barrier to the back side of one of the panels.

In another embodiment, the unit further comprises a plurality of brace plates, each having a plurality of bolt holes, each of the fastening bolts first penetrating one of the brace plates before penetrating one of the pillars and one of the panels.

In another embodiment, the number of panels between the first and second pillars is two, and the number of panels between the second and third pillars is two.

In another embodiment, the number of panels between the first and second pillars is three, and the number of panels between the second and third pillars is three.

In another embodiment, the number of panels between the first and second pillars is two or more, and the number of panels between the second and third pillars is two or more.

In another embodiment, vertically adjacent panels are tongued and grooved.

In another embodiment, each of the pillar positioning members is threadably joined to one of the pillar footings.

In another embodiment, the first pillar is adapted for fastening to a panel extending between the first pillar and the third pillar of a like barrier unit, and the third pillar is adapted for fastening to a panel extending between the third pillar and the first pillar of a like barrier unit.

In another embodiment, a plurality of like barrier units are attached in sequence by at least one panel attached between the first and third pillars of two adjacent units.

In another embodiment, the vapor barrier is sized to extend over the length of at least two of the combined units.

In another embodiment, each of the pillar positioning members is threadably attached to the pillar.

In another embodiment, the pillar positioning members are removable and reattachable.

There is also provided a barrier unit for connection to like barrier units to form a barrier on a ground surface to protect an area from flood waters is provided, comprising: five elongated brace members, each brace member having a coupling and a first and second portion, each brace member portion having a threaded end, each coupling joining the first and second portion threaded ends of each brace member; a first, second and third pillar, each pillar having a bottom, a positioning member extending downwardly beyond the pillar bottom, and a hole for receiving one of the brace member first portion ends, at least two of the pillars having an additional hole for receiving another of the brace member first portion ends, at least one of the pillars having a second additional hole for receiving yet another of the brace member first portion ends; a first, second and third brace member footing for securing into the ground surface, each having a hole for receiving one of the brace member second portion ends, at least two of the brace member footings each having at least one additional hole for receiving an additional brace member second portion end, the rotation of each of the brace member first portions moving one of the brace member first portion ends into one of the pillar holes, and the rotation of each of the brace member second portions moving one of the brace member second portion ends into one of the brace member footing holes; a first, second and third pillar footing for securing into the ground surface, each having a hole for receiving one of the pillar positioning members; a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars; the pillar and brace member footings being positioned such that the first brace member is compressively positioned between the first brace member footing and the first pillar, the second brace member is compressively positioned between the first brace member footing and the second pillar, the third brace member is compressively positioned between the second brace member footing and the second pillar, the fourth brace member is compressively positioned between the third brace member footing and the second pillar, and the fifth brace member is compressively positioned between the third brace member footing and the third pillar.

In addition, a barrier unit for connection to like barrier units to form a barrier on a ground surface to protect an area from flood waters is provided, comprising: a first, second and third pillar; a first second and third pillar footing and means for attaching each pillar to one of the pillar footings; means for bracing the first, second and third pillars; a plurality of barrier panels and means for fastening the barrier panels to the pillars to form a barrier; and means for preventing water seepage around the barrier panels.

In another embodiment, the barrier unit further comprises, means for connecting the barrier unit to like barrier units to form a continuous barrier.

Further, a barrier unit for connection to like barrier units to form a barrier on a ground surface to protect an area from flood waters is provided, comprising: nine elongated brace members, each brace member having a turnbuckle and a first and second portion, each brace member portion having a threaded end, each turnbuckle joining the first and second portion threaded ends of each brace member; a first, second and third pillar, each pillar having a bottom, a positioning member extending downwardly beyond the pillar bottom, and three holes, each hole being positioned for receiving one of the brace member first portion ends; a first, second and third brace member footing for securing into the ground surface, each having three holes, each hole being sized for receiving one of the brace member second portion ends; a first, second and third pillar footing for securing into the ground surface, each having a hole for receiving one of the pillar positioning members; a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars; the pillar and brace member footings being positioned such that the first brace member is compressively positioned between the first pillar and the third brace member footing of a like barrier unit, the second brace member is compressively positioned between the first brace member footing and the first pillar, the third brace member is compressively positioned between the second brace member footing and the first pillar, the fourth brace member is compressively positioned between the first brace member footing and the second pillar, the fifth brace member is compressively positioned between the second brace member footing and the second pillar, the sixth brace member is compressively positioned between the third brace member footing and the second pillar, the seventh brace member is compressively positioned between the second brace member footing and the third pillar, the eighth brace member is compressively positioned between the third brace member footing and the third pillar, and the ninth brace member is compressively positioned between the third pillar and the first brace member footing of a second like barrier unit.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES.

In order that the invention may be more fully understood, it will now be described, by way of example, with reference to the accompanying drawing in which.

DETAILED DESCRIPTION OF THE PREFERRED EMBODIMENTS

Figure 1:
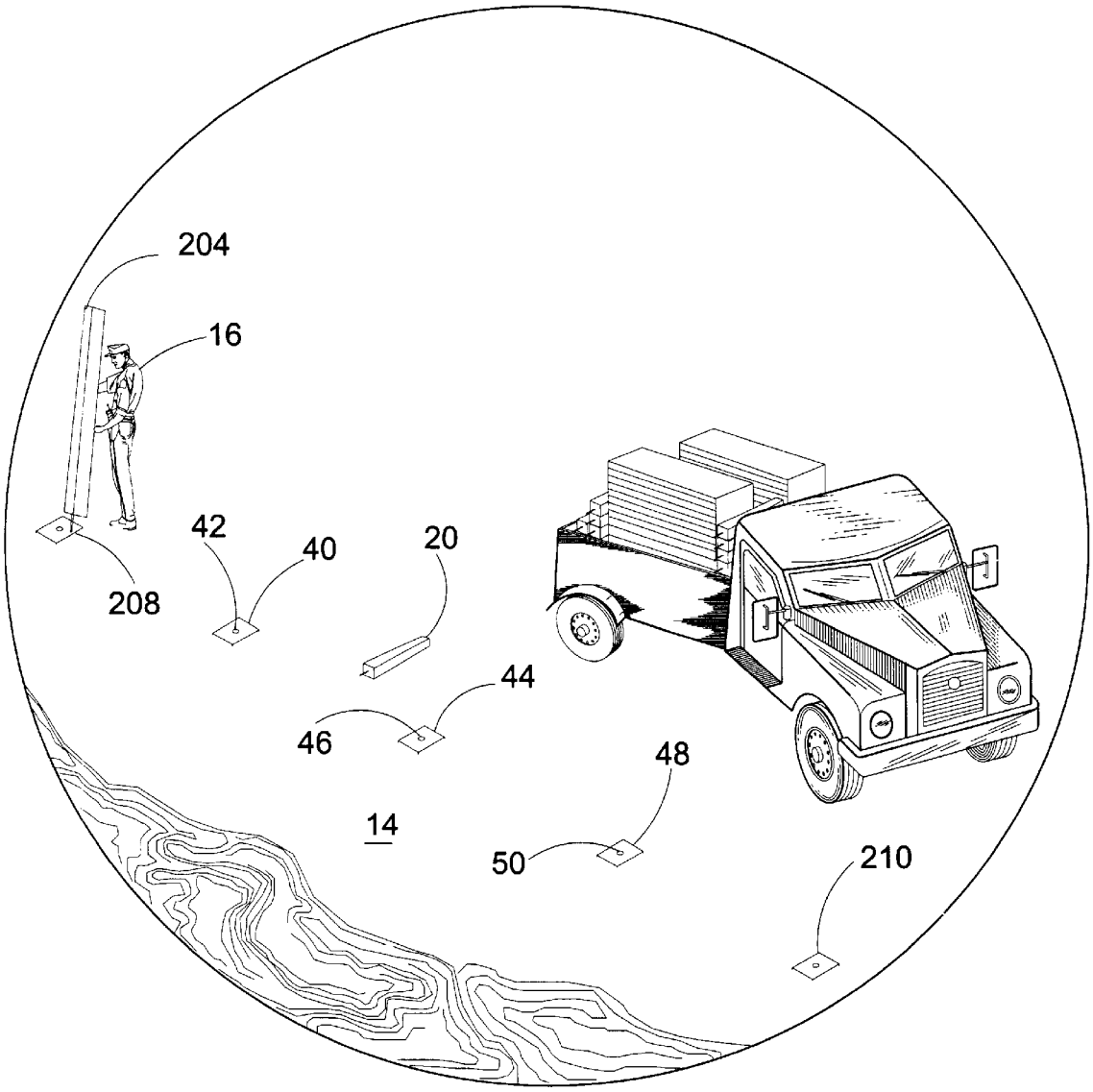
FIG. 1 is a pictorial illustration depicting a flood prone area containing stationary concrete pillar footings into which pillars are mounted and threaded. The barrier assemblies may be delivered to each location by a light truck and assembled on location.

Turning now descriptively to the drawings, in which similar reference characters denote similar elements throughout the several views, FIGS. 1–11 illustrate the Flood Barrier of the present invention, indicated generally by the numerals 10.

The flood barrier unit 10 and its components are shown generally in FIGS. 1–11 and in use with flood waters 12 in FIGS. 1–2 and 5–6.

The flood barrier unit 10 is part of a barrier system 14 wherein the flood barrier units 10 are connected with other units 200 to form a continuous barrier.

Figure 3:
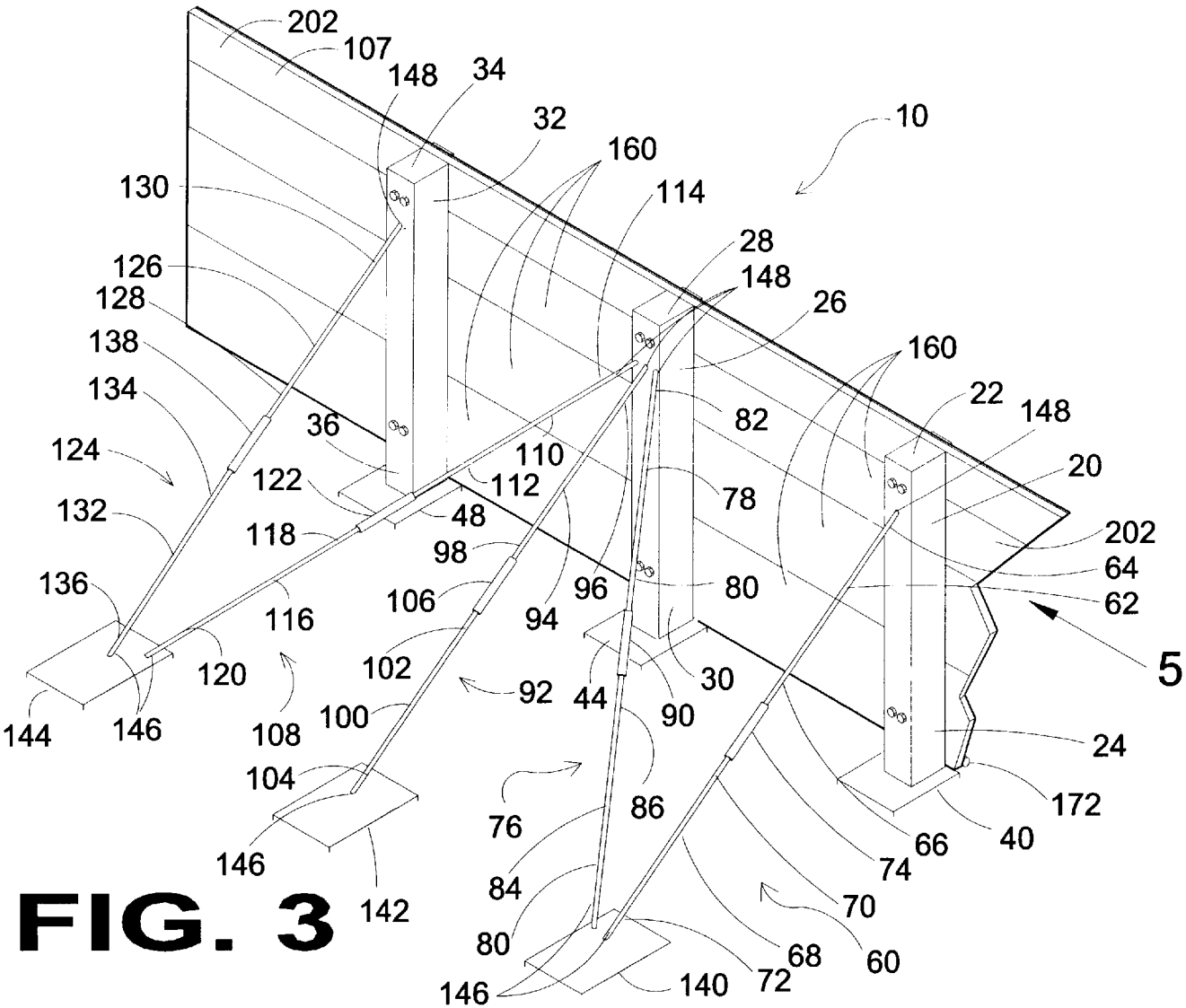
FIG. 3 is a pictorial view of the non-flood side (rear view) of the present invention.
Figure 4:
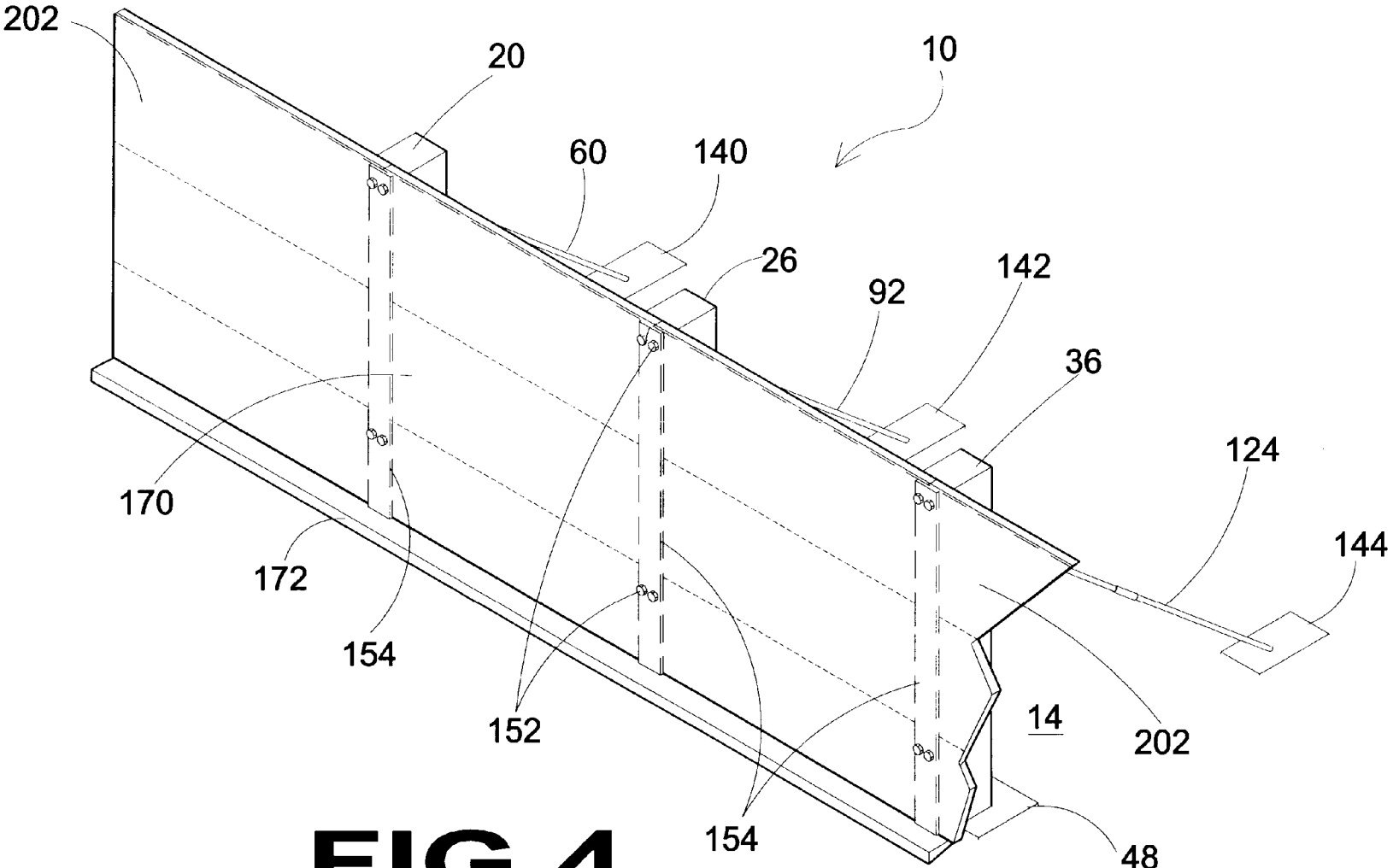
FIG. 4 is a perspective frontal view of the flood barrier unit of the present invention.
Figure 5:
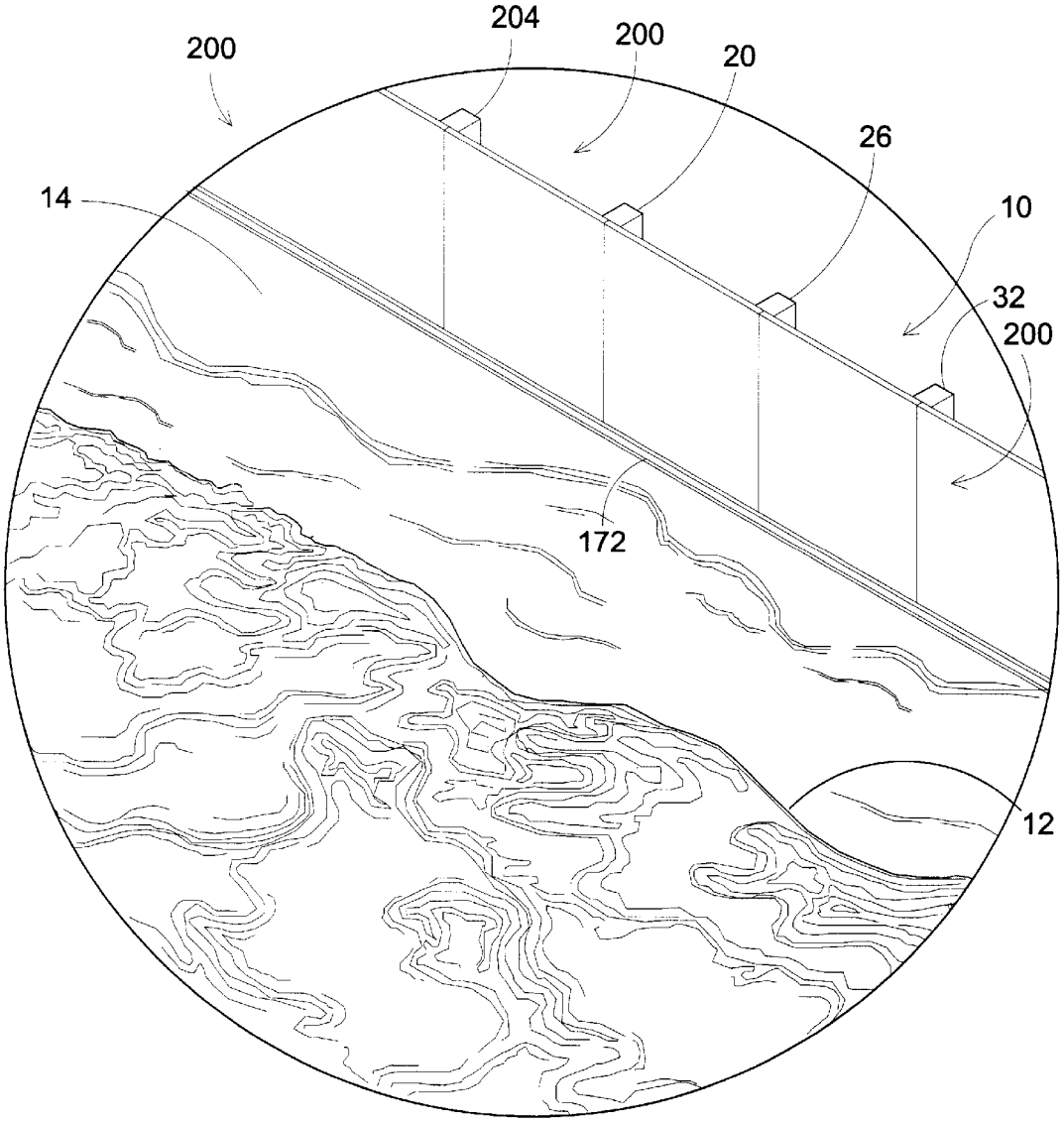
FIG. 5 is a pictorial illustration depicting the flood barrier system of the present invention assembled prior to the advancing flood waters.
Figure 6:
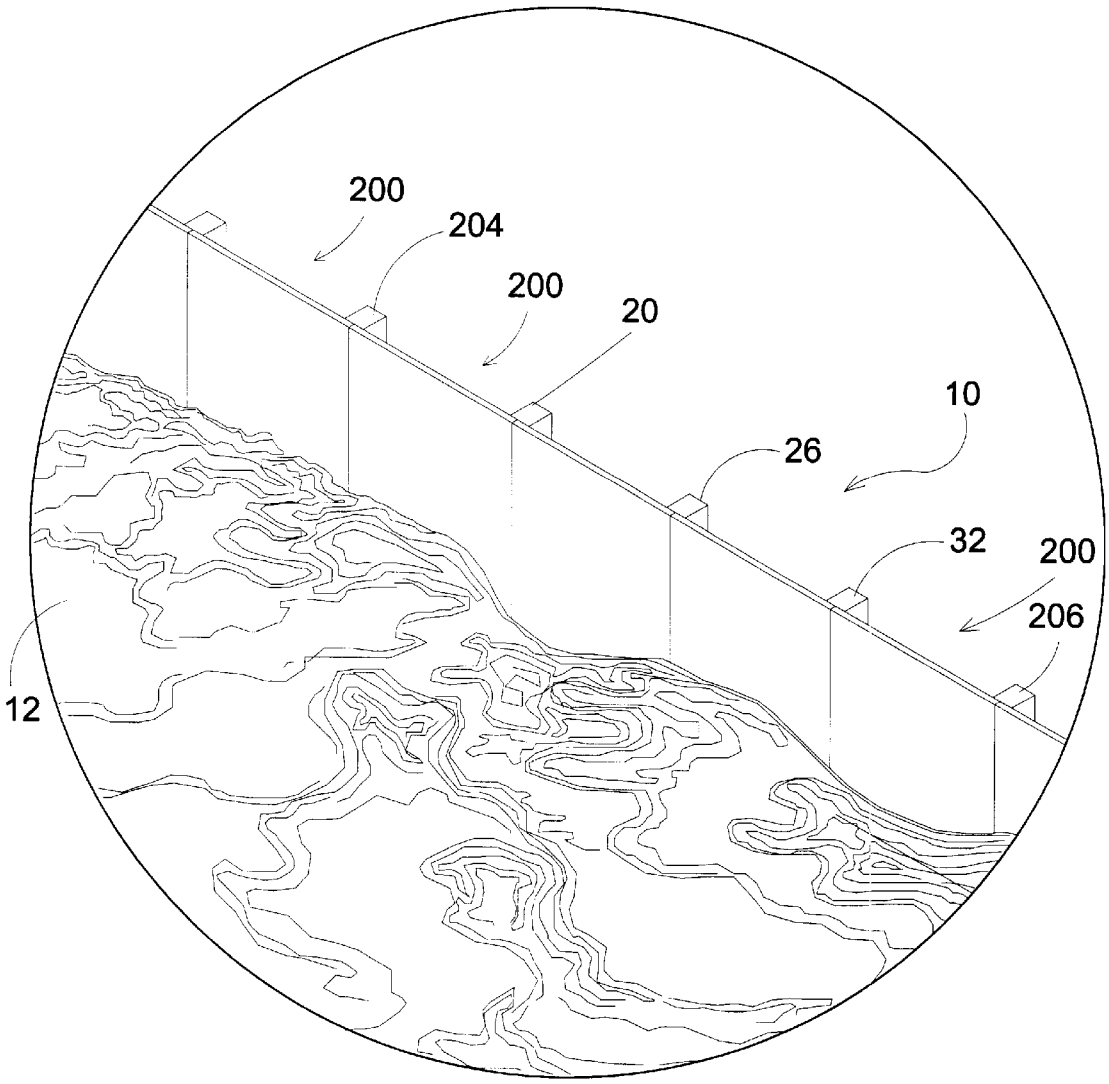
FIG. 6 is a pictorial illustration depicting advancing tidal surge being held back by the flood barrier system of the present invention.
Figure 7:
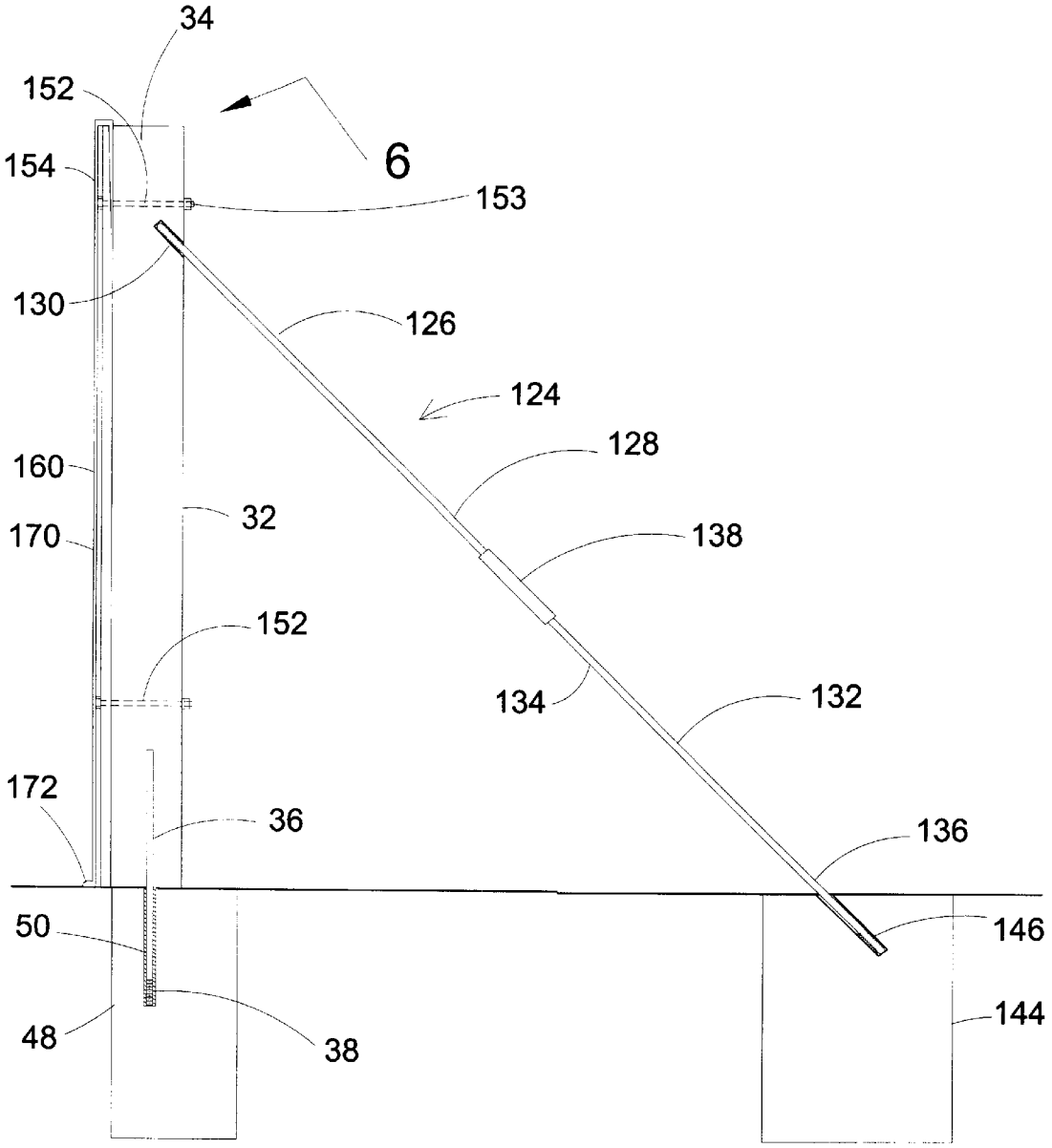
FIG. 7 is a side view of the flood barrier unit of the present invention.
Figure 8:
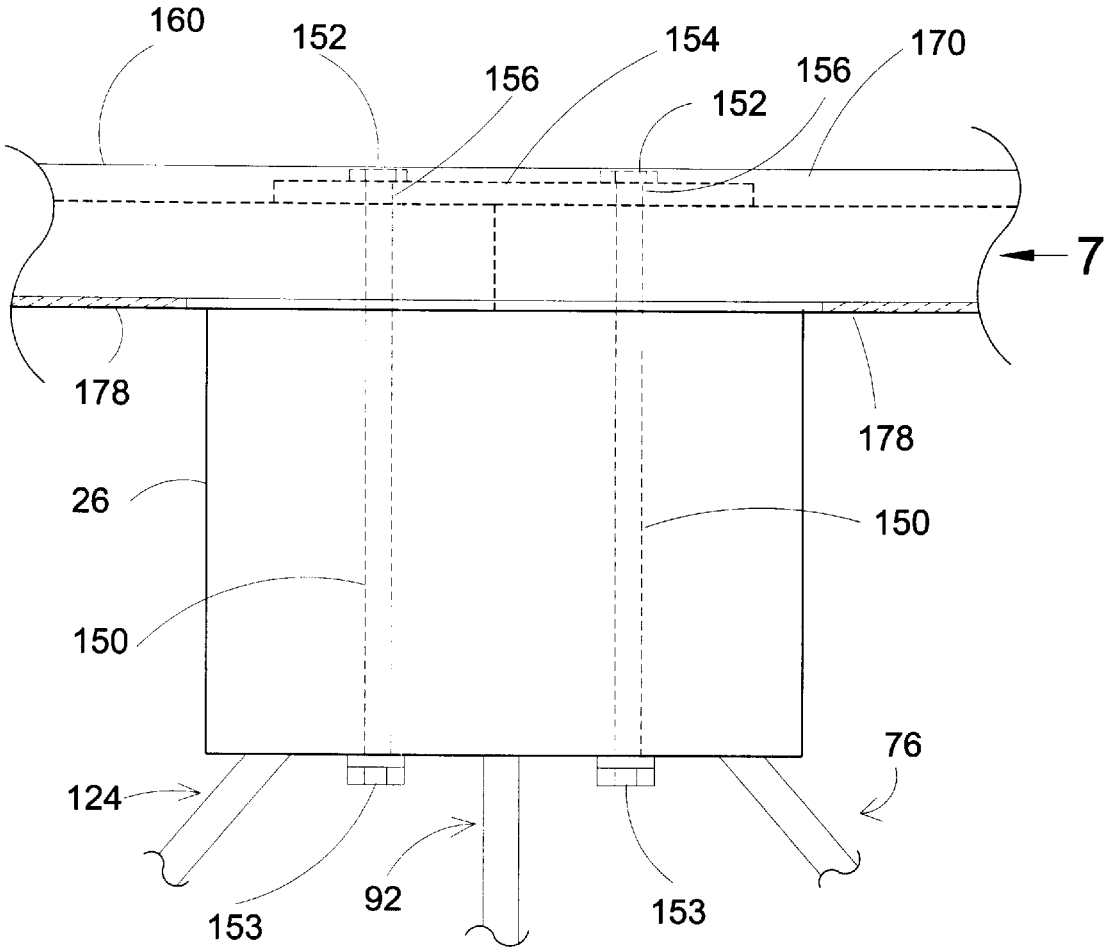
FIG. 8 is a top view of a section of the present invention showing bolts connecting a vapor barrier, brace plate and and barrier panels to the pillar.
Figure 9:
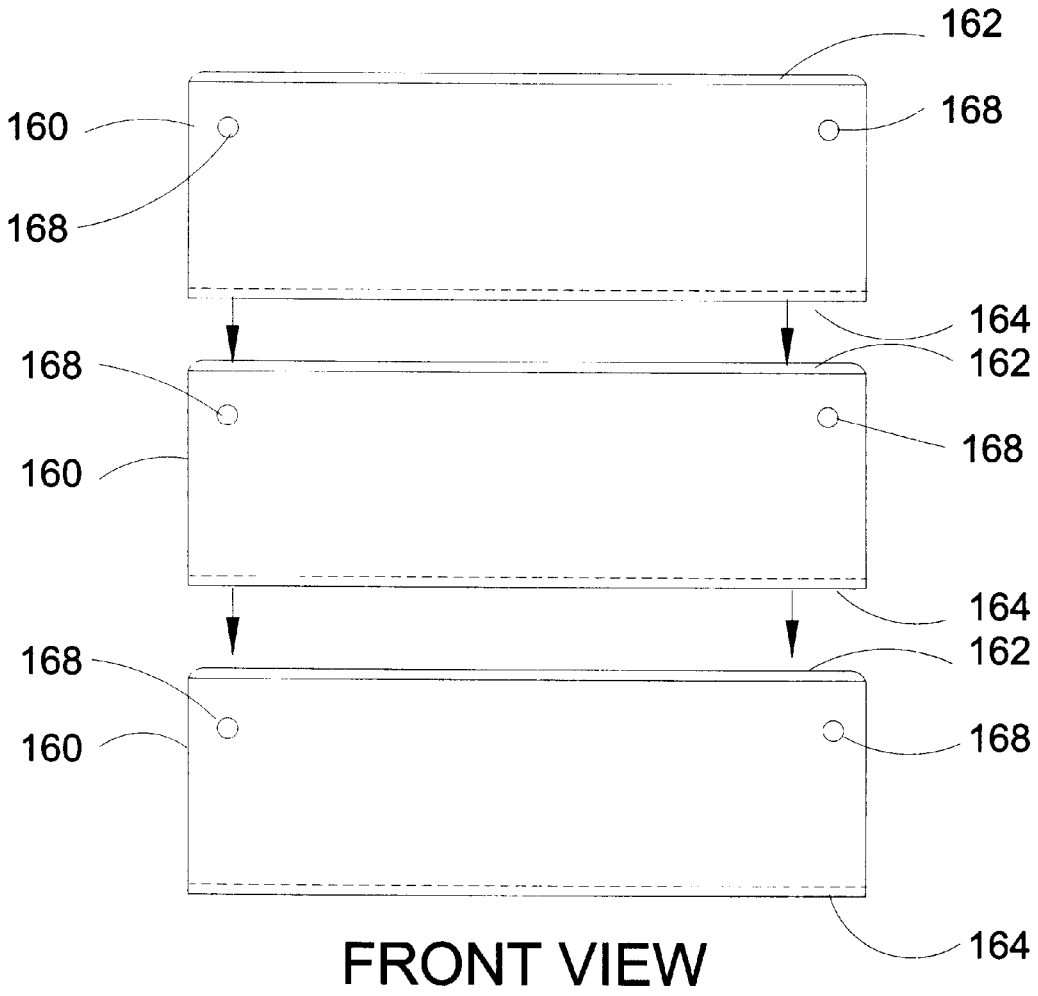
FIG. 9 is a front view of the barrier panels of the present invention.
Figure 10:
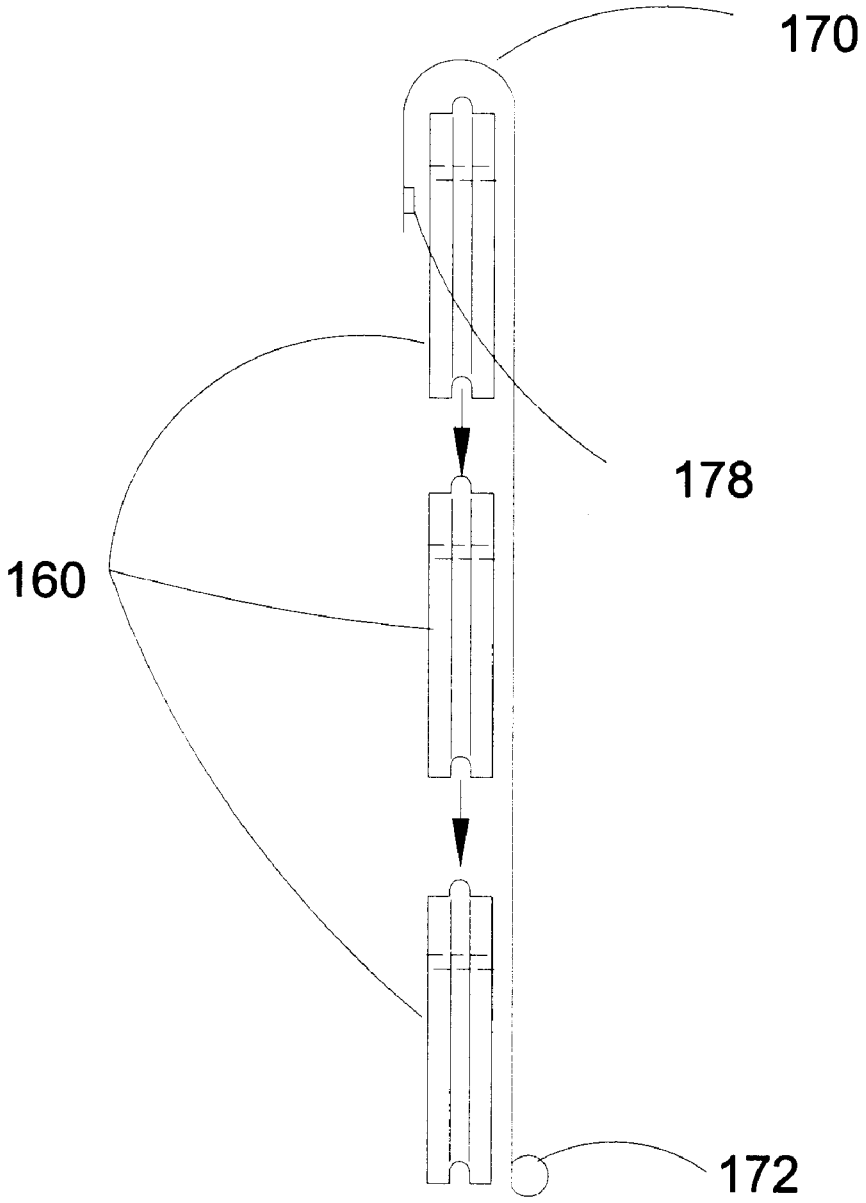
FIG. 10 is an exploded side view of the barrier panels with the vapor barrier draped over the top panel.

As shown in FIG. 3, each flood barrier unit 10 includes a first pillar 20 having a top 22 and bottom 24, a second pillar 26 having a top 28 and bottom 30, and a third pillar 32 having a top 34 and bottom 36. Each pillar 20,26,32 has a threaded, downwardly extending rod 38, as shown for the third pillar 32 in FIG. 7. The rod 38 can be permanently affixed to the pillar bottom 24,30,36 or it can be threadably inserted therein.

Each barrier unit 10 also includes a first pillar footing 40 having a threaded hole 42, a second pillar footing 44 having a threaded hole 46, and a third pillar footing 48 having a threaded hole 50. The pillar footings 40,44,48 are firmly implanted into the ground surface 14. The threaded holes 42,46,50 are sized to threadably receive the threaded rods 38 of the three pillars 20,26,32, which act as positioning members to rigidly attach the pillars 20,26,32 to the ground surface 14.

Also included in each barrier unit 10 is a first brace member 60 having a first portion 62, the first portion 62 having a first end 64 and a second end 66, and a second portion 68, the second portion 68 having a first end 70 and a second end 72. The first portion first end 64 and the second portion first end 72 are both threaded into a turnbuckle 74.

A second brace member 76 has a first portion 78, the first portion 78 having a first end 80 and a second end 82, and a second portion 84, the second portion 84 having a first end 86 and a second end 88. The first portion first end 80 and the second portion first end 86 are both threaded into a turnbuckle 90.

A third brace member 92 has a first portion 94, the first portion 94 having a first end 96 and a second end 98, and a second portion 100, the second portion 100 having a first end 102 and a second end 104. The first portion first end 96 and the second portion first end 102 are both threaded into a turnbuckle 106.

A fourth brace member 108 has a first portion 110, the first portion 110 having a first end 112 and a second end 114, and a second portion 116, the second portion 116 having a first end 118 and a second end 120. The first portion first end 112 and the second portion first end 118 are both threaded into a turnbuckle 122.

A fifth brace member 124 has a first portion 126, the first portion 126 having a first end 128 and a second end 130, and a second portion 132, the second portion 132 having a first end 134 and a second end 136. The first portion first end 128 and the second portion first end 134 are both threaded into a turnbuckle 138.

First, second, and third brace member footings 140,142,144 are included and are also implanted securely in the ground surface 14 in one-to-one correspondence with the three pillar footings 40,44,48. Each brace member footing 140,142,144 has at least one hole 146 sized to closely receive one of the brace member second portion second ends 72,88,104,120,136.

Similarly, each of the pillars 20,26,32 have holes 148 sized for closely receiving one of the brace member first portion second ends 66,82,98,114,130.

Each pillar 20,26,32 also includes bolt holes 150 for receiving bolts 152. Brace plates 154 with bolt holes 156 are also included.

The barrier unit 10 includes six barrier panels 160, each having tongue-and-groove top edges 162, bottom edges 164, and bolt holes 168.

A water-resistant vapor barrier 170 is also included, having a weighted portion 172 and a top portion 174, the top portion 174 having bolt holes 176. Hook-and-loop fasteners 178 are included for fastening the vapor barrier top portion 174 to the barrier panels 160.

Figure 2:
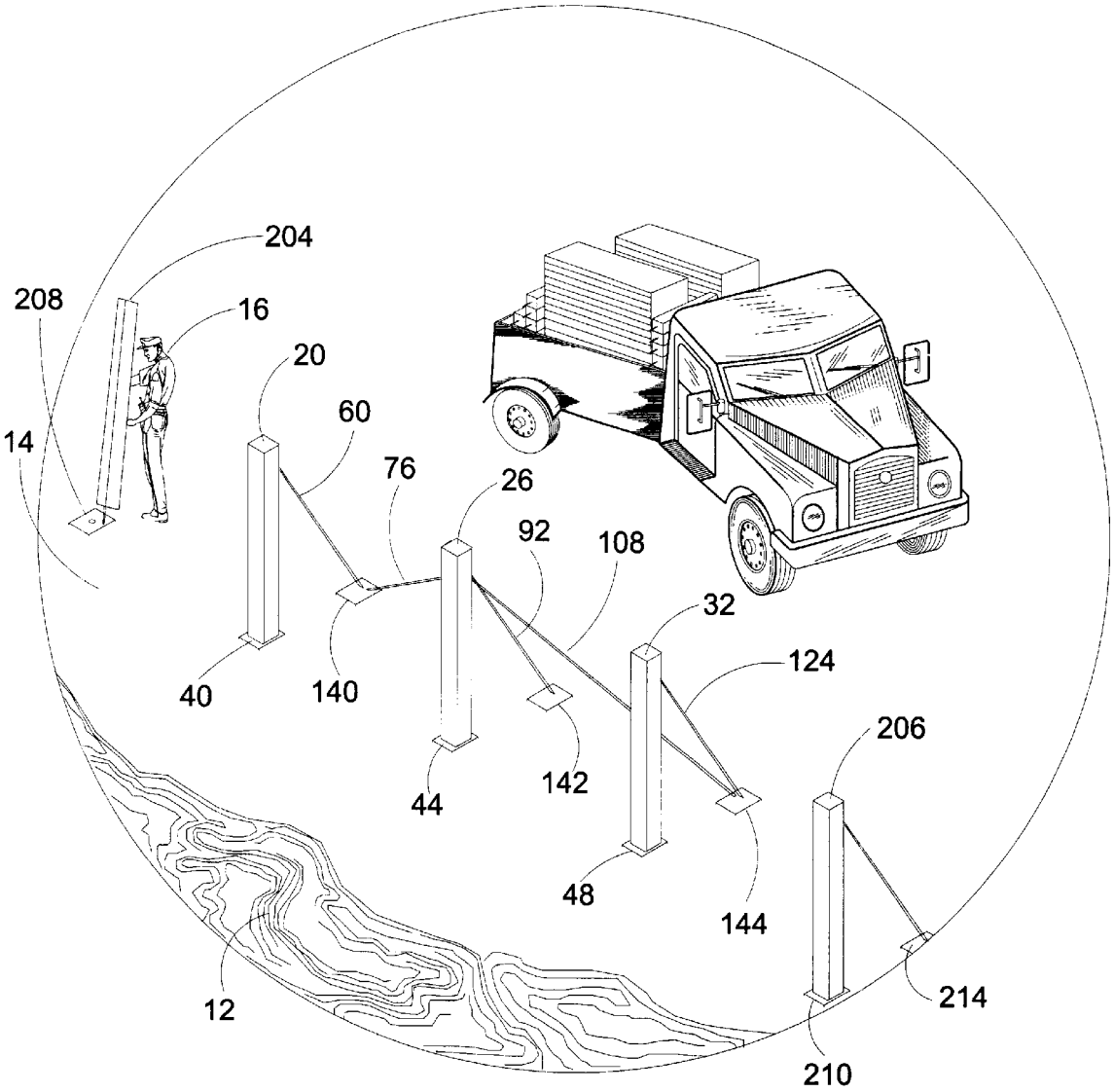
FIG. 2 is a pictorial illustration depicting a flood prone area where pillars have been erected and secured to the concrete pillar footings.

When the danger of rising flood waters becomes a reality, the installer 16 secures the pillar footings 40,42,44 and the brace member footings 140,142,144 in an arrangement similar to that shown in FIGS. 1–3. The pillars 20,26,32 are then attached by screwing the threaded rods 38 into the pillar footings 40,42,44.

The first brace member 60 is then assembled by threading the first brace member first portion first end 64 into the first turnbuckle 74 and inserting the first brace member first portion second end 66 into the pillar hole 148 on the first pillar 20. The pillar hole 148 is sized for a relatively tight fit to assist in holding the first portion 62 during subsequent manipulation of the turnbuckle 74. When the turnbuckle 74 is threaded far enough on the first portion first end 64, sufficient room exists to screw the first brace member second portion first end 70 into the turnbuckle 74 in amount sufficient to position the first brace member second portion second end 72 for insertion into the first brace member footing hole 146. Manipulation of the turnbuckle 74 then forces the second portion second end 72 into the hole 146. Continued manipulation of the turnbuckle 74 will place the first brace member 60 into compression between the first pillar 20 and the first brace member footing 140, as the first and second portion second ends 66,72 reach full insertion into holes 148,146.

This assembly procedure is repeated for the remaining four brace members 76,92,108,124, such that (1) the second brace member 76 is compressively positioned between the second pillar 30 and the first brace member footing 140, (2) the third brace member 92 is compressively positioned between the second pillar 30 and the second brace member footing 142, (3) the fourth brace member 108 is compressively positioned between the second pillar 30 and the third brace member footing 144, and (4) the fifth brace member 124 is compressively positioned between the third pillar 32 and the third brace member footing 144.

Once the pillars 20,26,32 are attached and braced, the barrier panels 160 are positioned against the pillars 20,26,32 such that top edges 162 of the middle and bottom panels 160 are adjacent the bottom edges 164 of the top and middle panels 160, respectively. When so joined, the barrier panel bolt holes 168 are aligned with the pillar bolt holes 150. An elongated brace plate 154 is similarly positioned against the barrier panels 160 such that brace plate bolt holes 156 are also aligned. Pillar bolts 152 are then inserted and fastened using a nut and washer combination 153.

During or after the foregoing barrier panel 160 attachment, the vapor barrier 170 is added to the assembly by draping the vapor barrier top portion 174 over the top barrier panel top edge 162 and using the hook-and-loop fasteners 178 to hold the vapor barrier 170 in place. Once secured in this manner, the pillar bolts 152 are also insertable through the vapor barrier top portion bolt holes 176 for further attachment integrity. When attached in this manner the vapor barrier weighted portion 172 extends to the ground surface 14 and prevents the direct contact of the water 12 with the barrier panels 160.

In particularly flood-prone areas, the pillar footings 40,44, 48 and brace member footings 140,142,144 can be permanently implanted for repeated use.

As mentioned above, the flood barrier unit 10 is part of a barrier system 14 wherein the flood barrier units 10 are connected with other like units 200 to form a continuous barrier. As shown in FIGS. 3–6, the connection is made to like units 200 using barrier panels 202 between the units 10,200 attached on one end to the first and third pillar 20,32 of the barrier unit 10, and the third and first pillar 204,206 of the like units 200, respectively. The system 10,200 includes an extended vapor barrier 170 covering more than one unit 10,200 in a seamless fashion.

Figure 11:
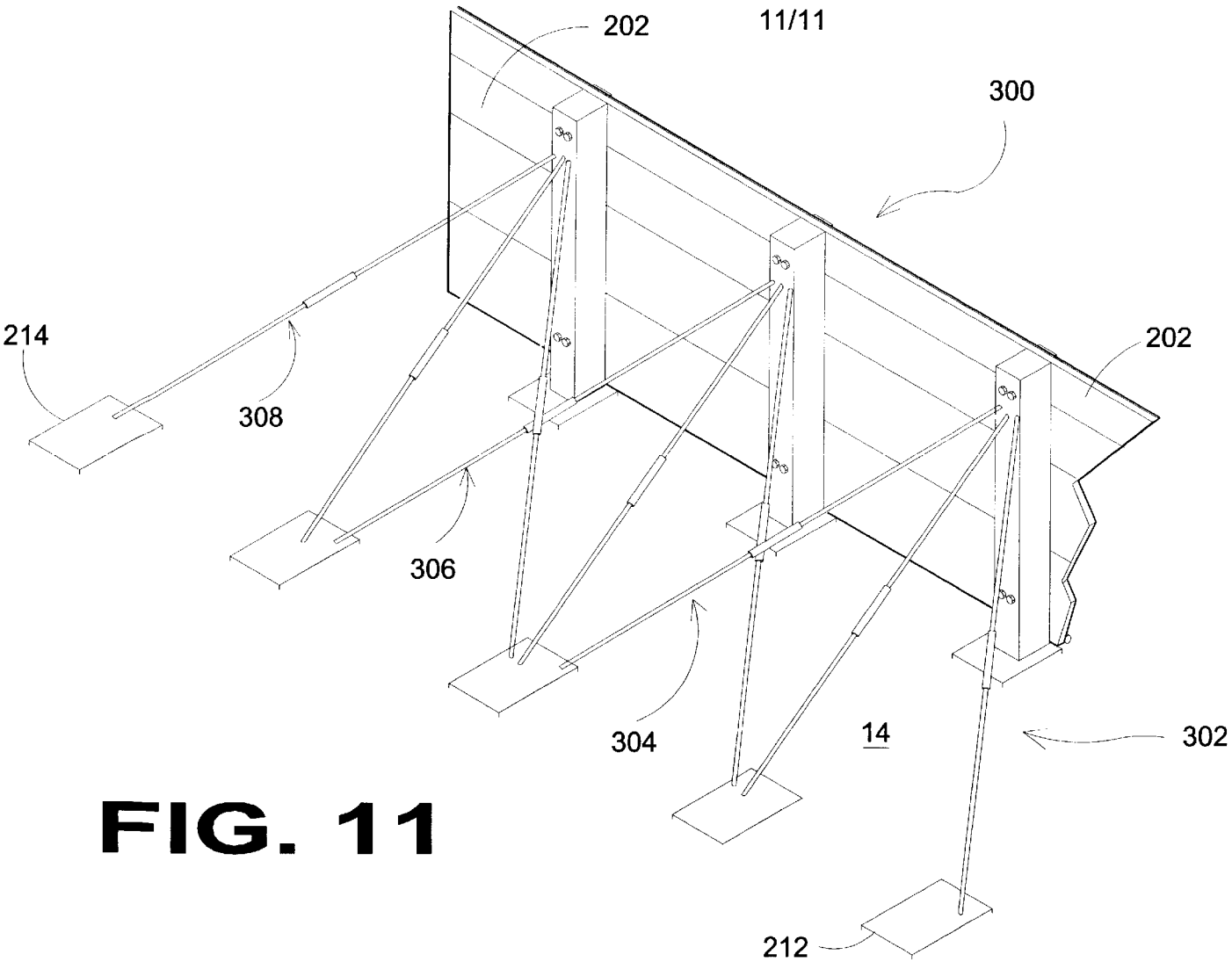
FIG. 11 is a rear view of the flood barrier unit for a second embodiment having nine brace members.

FIG. 11 depicts an alternate embodiment 300 that provides a continuous pattern of braces. A sixth, seventh, eighth, and ninth brace member 302,304,306,308 are added with appropriate additions of holes 148,146 in the three pillars 20,26,32 and the three brace member footings 140, 142,144. The sixth brace member 302 is available for connection to the third brace member footing 208 of an adjacent like unit 200. Similarly, the ninth brace member 308 is available for connection with the first brace member footing 210 of a second adjacent like unit 200. With the additional brace members 302,304,306,308 each pillar 20,26,32 is triple-braced.

In another embodiment, the turnbuckles are replaced by standard couplings. In this embodiment the pillar holes can be slightly enlarged to allow an easier hand rotation of the brace member first or second portions with respect to the coupling.

The device 10 and its foregoing components can be constructed using various materials, including (1) various water-resistant fabrics, e.g. treated canvas, plastic, and nylon, for the vapor barrier 170, (2) steel rods or tubes for the brace members 60,76,92,108,124,302,304,306,308, (3) concrete, steel, or rigid plastics for the pillars 20,26,32, pillar footings 40,44,48, and brace member footings 140,142,144, and (4) various woods, plastics and metals for the barrier panels 160. These materials, in various component combinations, can be sized to accommodate varying depths of expected flood levels. All such materials and sizings are in accordance with the present invention, as can be determined by the intended end use for the overall system, as will occur to those of skill in the art upon review of the present disclosure.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A barrier unit for connection to like barrier units to form a barrier on a ground surface to protect an area from flood waters, comprising:

five elongated brace members, each brace member having a turnbuckle and a first and second portion, each brace member portion having a threaded end, each turnbuckle joining the first and second portion threaded ends of each brace member;

a first, second and third pillar, each pillar having a bottom, a positioning member extending downwardly beyond the pillar bottom, and a hole for receiving one of the brace member first portion ends, at least two of the pillars having an additional hole for receiving another of the brace member first portion ends, at least one of the pillars having a second additional hole for receiving yet another of the brace member first portion ends;

a first, second and third brace member footing for securing into the ground surface, each having a hole for receiving one of the brace member second portion ends, at least two of the brace member footings each having at least one additional hole for receiving an additional brace member second portion end, the rotation of each turnbuckle moving each brace member first portion end into one of the pillar holes and each brace member second portion end into one of the brace member footing holes;

a first, second and third pillar footing for securing into the ground surface, each having a hole for receiving one of the pillar positioning members;

a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars;

the pillar and brace member footings being positioned such that the first brace member is compressively positioned between the first brace member footing and the first pillar, the second brace member is compressively positioned between the first brace member footing and the second pillar, the third brace member is compressively positioned between the second brace member footing and the second pillar, the fourth brace member is compressively positioned between the third brace member footing and the second pillar, and the fifth brace member is compressively positioned between the third brace member footing and the third pillar.

2. The barrier unit of claim 1, wherein the panels are fastened to the pillars by bolts.

3. The barrier unit of claim 2, wherein the vapor barrier is penetrated by at least one bolt on each of the pillars.

4. The barrier unit of claim 3, further comprising at least one hook and loop fastener for fastening the vapor barrier to at least one of the panels.

5. The barrier unit of claim 4, wherein each of the panels has a back side, each of the hook and loop fasteners fastening the vapor barrier to the back side of one of the panels.

6. The barrier unit of claim 2, further comprising a plurality of brace plates, each having a plurality of bolt holes, each of the fastening bolts first penetrating one of the brace plates before penetrating one of the pillars and one of the panels.

7. The barrier unit of claim 1, wherein the number of panels between the first and second pillars is two, and the number of panels between the second and third pillars is two.

8. The barrier unit of claim 1, wherein the number of panels between the first and second pillars is three, and the number of panels between the second and third pillars is three.

9. The barrier unit of claim 1, wherein the number of panels between the first and second pillars is two or more, and the number of panels between the second and third pillars is two or more.

10. The barrier unit of claim 9, wherein vertically adjacent panels are tongued and grooved.

11. The barrier unit of claim 1, wherein each of the pillar positioning members is threadably joined to one of the pillar footings.

12. The barrier unit of claim 1, wherein the first pillar is adapted for fastening to a panel extending between the first pillar and the third pillar of a like barrier unit, and the third pillar is adapted for fastening to a panel extending between the third pillar and the first pillar of a like barrier unit.

13. The barrier unit of claim 1, wherein a plurality of like barrier units are attached in sequence by at Least one panel attached between the first and third pillars of two adjacent units.

14. The barrier unit of claim 13, wherein the vapor barrier is sized to extend over the length of at least two of the combined units.

15. The barrier unit of claim 1, wherein each of the pillar positioning members is threadably attached to the pillar.

16. The barrier unit of claim 1, wherein the pillar positioning members are removable and reattachable.

17. A barrier unit for connection to like barrier units to form a barrier on a ground surface to protect an area from flood waters, comprising:

five elongated brace members, each brace member having a coupling and a first and second portion, each brace member portion having a threaded end, each coupling joining the first and second portion threaded ends of each brace member;

a first, second and third pillar, each pillar having a bottom, a positioning member extending downwardly beyond the pillar bottom, and a hole for receiving one of the brace member first portion ends, at least two of the pillars having an additional hole for receiving another of the brace member first portion ends, at least one of the pillars having a second additional hole for receiving yet another of the brace member first portion ends;

a first, second and third brace member footing for securing into the ground surface, each having a hole for receiving one of the brace member second portion ends, at least two of the brace member footings each having at least one additional hole for receiving an additional brace member second portion end, the rotation of each of the brace member first portions moving one of the brace member first portion ends into one of the pillar holes, and the rotation of each of the brace member second portions moving one of the brace member second portion ends into one of the brace member footing holes;

a first, second and third pillar footing for securing into the ground surface, each having a hole for receiving one of the pillar positioning members;

a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars;

the pillar and brace member footings being positioned such that the first brace member is compressively positioned between the first brace member footing and the first pillar, the second brace member is compressively positioned between the first brace member footing and the second pillar, the third brace member is compressively positioned between the second brace member footing and the second pillar, the fourth brace member is compressively positioned between the third brace member footing and the second pillar, and the fifth brace member is compressively positioned between the third brace member footing and the third pillar.

18. A barrier unit for connection to like barrier units to form a barrier on a ground surface to protect an area from flood waters, comprising:

nine elongated brace members, each brace member having a turnbuckle and a first and second portion, each brace member portion having a threaded end, each turnbuckle joining the first and second portion threaded ends of each brace member;

a first, second and third pillar, each pillar having a bottom, a positioning member extending downwardly beyond the pillar bottom, and three holes, each hole being positioned for receiving one of the brace member first portion ends;

a first, second and third brace member footing for securing into the ground surface, each having three holes, each hole being sized for receiving one of the brace member second portion ends;

a first, second and third pillar footing for securing into the ground surface, each having a hole for receiving one of the pillar positioning members;

a plurality of panels, at least one of the panels being fastenable to the first and second pillars to form a barrier between the first and second pillars, at least one of the panels being fastenable to the second and third pillars to form a barrier between the second and third pillars; and a vapor barrier having a top edge, a bottom edge, and a weighted portion attached proximate the bottom edge, the top edge being draped over the panels and fastened between the panels and the pillars;

the pillar and brace member footings being positioned such that the first brace member is compressively positioned between the first pillar and the third brace member footing of a like barrier unit, the second brace member is compressively positioned between the first brace member footing and the first pillar, the third brace member is compressively positioned between the second brace member footing and the first pillar, the fourth brace member is compressively positioned between the first brace member footing and the second pillar, the fifth brace member is compressively positioned between the second brace member footing and the second pillar, the sixth brace member is compressively positioned between the third brace member footing and the second pillar, the seventh brace member is compressively positioned between the second brace member footing and the third pillar, the eighth brace member is compressively positioned between the third brace member footing and the third pillar, and the ninth brace member is compressively positioned between the third pillar and the first brace member footing of a second like barrier unit.

* * * * *